US010957248B1

(12) United States Patent
Zheng et al.

(10) Patent No.: US 10,957,248 B1
(45) Date of Patent: Mar. 23, 2021

(54) DISPLAY PANEL AND MOBILE TERMINAL

(71) Applicant: Wuhan China Star Optoelectronics Semiconductor Display Technology Co., Ltd., Wuhan (CN)

(72) Inventors: Min Zheng, Wuhan (CN); Mugyeom Kim, Wuhan (CN)

(73) Assignee: Wuhan China Star Optoelectronics Semiconductor Display Technology Co., Ltd., Wuhan (CN)

( * ) Notice: Subject to any disclaimer, the term of this patent is extended or adjusted under 35 U.S.C. 154(b) by 0 days.

(21) Appl. No.: 16/846,343

(22) Filed: Apr. 12, 2020

(51) Int. Cl.
*G09G 3/3225* (2016.01)

(52) U.S. Cl.
CPC ... *G09G 3/3225* (2013.01); *G09G 2320/0626* (2013.01); *G09G 2360/144* (2013.01); *G09G 2380/02* (2013.01)

(58) Field of Classification Search
USPC ..... 345/207
See application file for complete search history.

(56) References Cited

U.S. PATENT DOCUMENTS

2002/0027229 A1* 3/2002 Yamazaki ..... G01J 1/44 257/84
2004/0069990 A1* 4/2004 Mahajani ..... H01L 29/513 257/66
2008/0024476 A1* 1/2008 Choi ..... G02F 1/1362 345/207
2010/0201664 A1* 8/2010 Lee ..... H01L 27/288 345/207
2011/0157044 A1* 6/2011 Yu ..... G06F 3/0418 345/173
2015/0364527 A1* 12/2015 Wang ..... H01L 27/3244 257/40
2016/0013243 A1* 1/2016 O'Rourke ..... H01L 31/028 257/43
2016/0104422 A1* 4/2016 Kishi ..... G09G 3/006 345/205
2018/0052106 A1* 2/2018 Gunning ..... C12Q 2563/107
2018/0090553 A1* 3/2018 Rieutort-Louis ... H01L 27/3276
2019/0164493 A1* 5/2019 Liu ..... G09G 3/3258
2020/0027941 A1* 1/2020 Luan ..... H01L 31/02016
2020/0202783 A1* 6/2020 Cheng ..... G09G 3/3266

* cited by examiner

*Primary Examiner* — Chineyere D Wills-Burns
(74) *Attorney, Agent, or Firm* — Nathan & Associates; Menachem Nathan

(57) ABSTRACT

The disclosure provides a display panel and a terminal device. The display panel includes an array substrate, wherein the array substrate includes a plurality of sub-pixel areas, a sub-pixel driving circuit is disposed in the sub-pixel areas, and a plurality of light detecting areas are disposed between adjacent sub-pixel pixel areas; a plurality of photocurrent sensors, wherein the photocurrent sensors are disposed in the light detecting areas and are connected to the sub-pixel driving circuit; a display device layer, wherein the display device layer is disposed on the array substrate and the photocurrent sensors; and a first controller, wherein the first controller is connected to the sub-pixel driving circuit. The photocurrent sensors detect a brightness of ambient light entering the light detecting areas and convert photo signals into electrical signals. Then, a blocking area and a non-blocking area are recognized by the first controller.

7 Claims, 3 Drawing Sheets

DISPLAY PANEL AND MOBILE TERMINAL

FIELD

The present disclosure relates to the field of display technologies, and more particularly, relates to a display panel and a mobile terminal.

BACKGROUND

When mobile terminals are used outdoors, because of limited auto-brightness adjustment capability of mobile terminals, people need to block ambient light using their hands or other objects if the ambient light is overly strong, to increase image contrast of the mobile terminals in a blocked area. As a result, people can clearly see content displayed by the mobile terminals in the blocked area.

As shown in FIG. 1, a schematic view where an area of a mobile terminal is blocked is shown. Because a user's hands or other objects can only block a portion of ambient light 1, the mobile terminal is divided into a non-blocked area A and a blocked area B. When the mobile terminal is irradiated with the ambient light 1, an amount of the ambient light 1 entering the blocked area B is less than an amount of the ambient light 1 entering the non-blocked area A, so that a brightness of the blocked area B is higher than a brightness of the non-blocked area A. As a result, contrast in the blocked area B needs to be higher than contrast in the non-blocked area A. Therefore, people may notice that the brightness of the non-blocked area A and the brightness of the blocked area B are non-uniform when light 2 of an image emitted from the non-blocked area A of the mobile terminal and light 2' of the image emitted from the blocked area B of the mobile terminal enter their eyes.

In summary, contrast in a blocked area and contrast in a non-blocked area are non-uniform when conventional mobile terminals are irradiated with ambient light. Consequently, it is necessary to provide a display panel and a mobile terminal to solve such defect.

SUMMARY

The present disclosure provides a display panel and a mobile terminal to solve a problem that contrast in a blocked area and contrast in a non-blocked area are non-uniform when conventional terminals are irradiated with ambient light.

The present disclosure provides a display panel, including:

an array substrate, wherein the array substrate includes a plurality of sub-pixel areas arranged in an array, a sub-pixel driving circuit is disposed in the sub-pixel areas, and a plurality of light detecting areas are disposed between adjacent sub-pixel areas;

a plurality of photocurrent sensors, wherein the photocurrent sensors are disposed in the light detecting areas and are connected to the sub-pixel driving circuit;

a display device layer, wherein the display device layer is disposed on the array substrate and the photocurrent sensors; and a first controller, wherein the first controller is connected to the sub-pixel driving circuit.

According to one embodiment of the present disclosure, the photocurrent sensors include a gate line layer, a tunnel layer, and a source/drain electrode layer which are stacked, and a material of the tunnel layer includes metal oxide.

According to one embodiment of the present disclosure, the metal oxide includes indium gallium zinc oxide, indium gallium oxide, indium tin zinc oxide, or aluminum zinc oxide.

According to one embodiment of the present disclosure, the array substrate includes a substrate and a buffer layer disposed on the substrate, and the photocurrent sensors are disposed between the display device layer and the buffer layer.

According to one embodiment of the present disclosure, the sub-pixel driving circuit includes a plurality of thin film transistors (TFTs), and the TFTs include at least one oxide TFT.

According to one embodiment of the present disclosure, the oxide TFT and the photocurrent sensors have a same structure and are disposed in a same layer.

According to one embodiment of the present disclosure, the TFTs include a driving TFT disposed on a side of the buffer layer away from the substrate, the driving TFT includes a first tunnel layer, a first gate line layer, and a first source/drain electrode layer, and the first gate line layer is disposed on a side of the first tunnel layer away from the substrate.

According to one embodiment of the present disclosure, the sub-pixel driving circuit includes seven TFTs and one storage capacitor.

According to one embodiment of the present disclosure, the first controller is a microcontroller or a central controller.

The present disclosure further provides a mobile terminal, including the above display panel.

Regarding the beneficial effects: an embodiment of the present disclosure provides a display panel. A plurality of photocurrent sensors are disposed on a plurality of light detecting areas between adjacent sub-pixel areas, different photocurrent sensors on different light defecting areas detect ambient brightnesses of different areas, photo signals are converted into electrical signals by a sub-pixel driving circuit, and a blocked area and a non-blocked area can be recognized by a first controller according to the electrical signals in different sub-pixel areas. As a result, the sub-pixel areas of the non-blocked area can be compensated, a brightness of the non-blocked area can increase, and contrast uniformity in the display panel and contrast uniformity between the blocked area of the mobile terminal and the non-blocked area of the mobile terminal can be realized.

DESCRIPTION OF DRAWINGS

The accompanying figures to be used in the description of embodiments of the present disclosure or prior art will be described in brief to more clearly illustrate the technical solutions of the embodiments or the prior art. The accompanying figures described below are only part of the embodiments of the present disclosure, from which those skilled in the art can derive further figures without making any inventive efforts.

DETAILED DESCRIPTION

Figure 1:
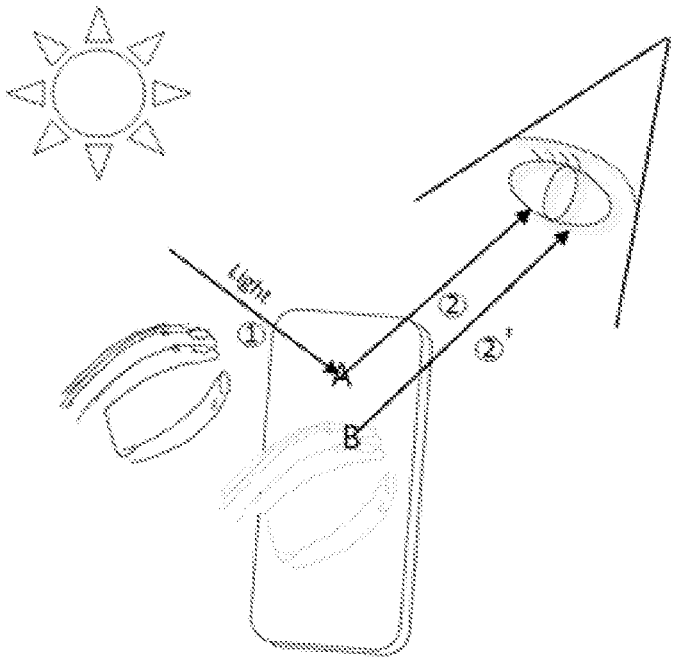
FIG. 1 is a schematic view showing where an area of a mobile terminal is blocked.

The following description of the various embodiments is provided with reference to the accompanying drawings to demonstrate the embodiments of the present disclosure. It should be understood that terms such as "upper," "lower," "front," "rear," "left," "right," "inside," "outside," "lateral" as well as derivative thereof should be construed to refer to the orientation as then described or as shown in the drawings under discussion. These relative terms are for convenience of description, do not require that the present disclosure be constructed or operated in a particular orientation, and shall not be construed as causing limitations to the present disclosure. In the drawings, the identical or similar reference numerals constantly denote the identical or similar elements or elements having the identical or similar functions.

The present disclosure is further described below in conjunction with accompanying drawings and specific embodiments.

An embodiment of the present disclosure provides a display panel, which is illustrated below in detail in conjunction with FIG. 1 to FIG. 3.

Figure 2:
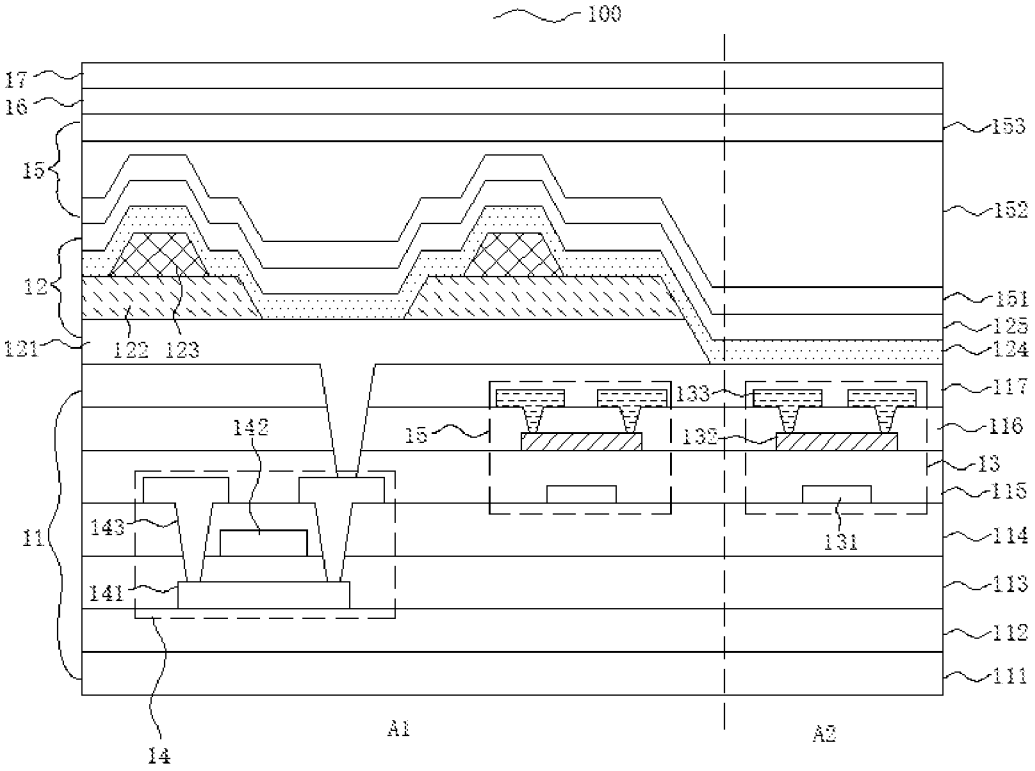
FIG. 2 is a schematic sectional structural view showing a display panel provided by an embodiment of the present disclosure.

As shown in FIG. 2, a schematic sectional structural of a display panel 100 provided by the present embodiment is shown. The display panel 100 includes an array substrate 11, a display device layer 12, a plurality of photocurrent sensors 13, and a first controller (not shown). A sub-pixel driving circuit is connected to both the photocurrent sensors 13 and the first controller.

Figure 3:
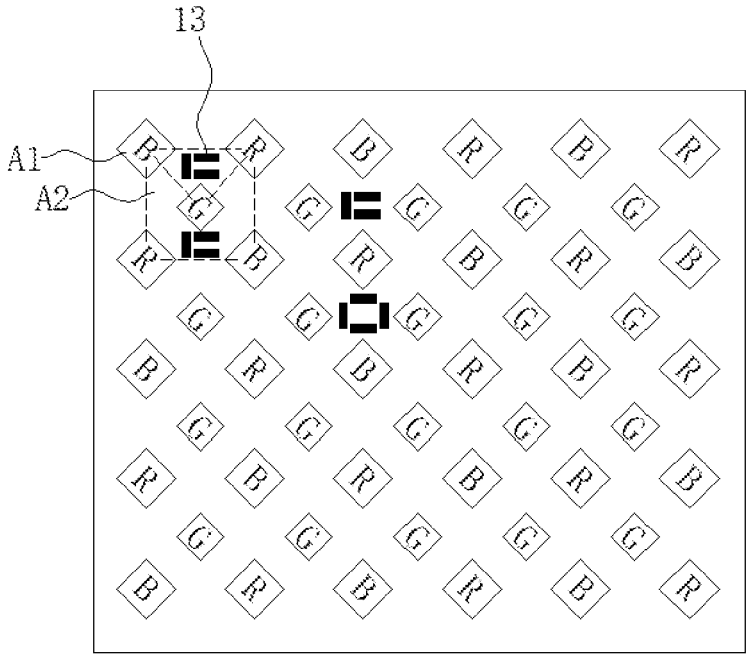
FIG. 3 is a schematic plan structural view showing the display panel provided by the embodiment of the present disclosure.

As shown in FIG. 3, a schematic plan structural view showing the display panel 100 provided by the present embodiment is shown. The array substrate 11 includes a plurality of sub-pixel areas A1 arranged in an array, the pixel driving circuit is disposed in the sub-pixel areas A1, and a plurality of light detecting areas A2 is disposed between adjacent sub-pixel areas A1. The photocurrent sensors 13 are disposed in the light detecting areas A2, and each of the sub-pixel areas A1 corresponds to one of the photocurrent sensors 13.

Preferably, the photocurrent sensors 13 on the adjacent sub-pixel areas A1 may be disposed in a same light detecting area A2. Furthermore, a plurality of black matrices may be disposed between adjacent photocurrent sensors 13, thereby preventing light entering the photocurrent sensors 13 on the adjacent sub-pixel areas A1 from occurring a crosstalk, which affects light detecting effect. On the other hand, in some embodiments, the photocurrent sensors 13 on the adjacent sub-pixel areas A1 may also be disposed in different light detecting areas A2, which is not limited here.

As shown in FIG. 2, the array substrate 11 includes an array base plate 111, a buffer layer 112, a first gate insulating layer 113, a first interlayer insulating layer 114, a second interlayer insulating layer 115, a second gate insulating layer 116, and a planarization layer 117, which are stacked.

In the present embodiment, the display device layer 12 is disposed on the array substrate 11 and the photocurrent sensors 13. The display device layer 12 includes an anode 121, a pixel defining layer 122, a plurality of spacers 123, a luminescent layer 124, and a cathode 125. The pixel defining layer 122 is disposed on the anode 121. A through hole is defined on the pixel defining layer 122 to expose a portion of the anode 121 on a bottom side of the pixel defining layer 122. The luminescent layer 124 covers the spacers 123 and the pixel defining layer 122 and is in contact with the anode 121 by the through hole. The cathode 125 covers the luminescent layer 124.

As shown in FIG. 2, the photocurrent sensors 13 are disposed between display device layer 12 and the buffer layer 112 and include a gate line layer 131, a tunnel layer 132, and a source/drain electrode layer 133, which are stacked. The gate line layer 131 is disposed on the first interlayer insulating layer 114 of the array substrate 11, the tunnel layer 132 is disposed on the second interlayer insulating layer 115, and the source/drain electrode layer 133 is disposed on the second gate insulating layer 116 and is in contact with the tunnel layer 132 by a through hole penetrating through the second gate insulating layer 116. The gate line layer 131, the tunnel layer 132, and the source/drain electrode layer 133 constitute a metal oxide thin film transistor (TFT) together.

Specifically, a material of the tunnel layer 132 includes a metal oxide. During a contrast adjustment process, ambient light passes through layers on the light detecting areas and enters the photocurrent sensors 13, and the tunnel layer 132 containing the metal oxide converts photoelectrons into a current when being irradiated with the ambient light to form a reverse current. The reverse current generated by the photocurrent sensors 13 results in changes in current in the sub-pixel driving circuit, thereby converting photosignals of the ambient light into corresponding electrical signals. The first controller receives the electrical signals and recognizes a blocked area B, which is blocked by an object, and a non-blocked area A as shown in FIG. 1 according to amounts of changes in current in the sub-pixel driving circuit in different areas. Then, the first controller generates corresponding control signals to provide an internal compensation circuit or an external compensation voltage for the sub-pixel driving circuit in the non-blocked area A, thereby enlarging current in the sub-pixel driving circuit in the non-blocked area A. As a result, a brightness of the non-blocked area A increases, so that contrast in the blocked area B may be same as contrast in the non-blocked area A. Therefore, though the display panel 100 is blocked, contrast uniformity between the non-blocked area A and the blocked area B can be realized. In the present embodiment, a method of providing the internal compensation circuit or the external compensation voltage for the sub-pixel driving circuit is similar to a conventional method for compensating a sub-pixel driving circuit, and is not described again here.

Preferably, the metal oxide includes indium gallium zinc oxide, indium gallium oxide, indium tin zinc oxide, or aluminum zinc oxide.

Preferably, the first controller is a microcontroller or a central controller. The first controller receives and processes electrical signals to recognize the non-blocked area A and the blocked area B, and then generates corresponding control signals to compensate the sub-pixel driving circuit. Therefore, a brightness of the non-blocked area increases.

In the present embodiment, the sub-pixel driving circuit is a 7T1C sub-pixel driving circuit including seven TFTs and one storage capacitor. The seven TFTs include one driving TFT 14 and six switch transistors 15. The driving TFT 14 and the six switch transistors 15 are low-temperature polysilicon TFTs (LTPS-TFTs). Furthermore, the metal oxide TFT (photocurrent sensors 13) may also be merged with the 7T1C sub-pixel driving circuit, thereby forming an 8T1C sub-pixel driving circuit having one metal oxide TFT.

Of course, in some embodiments, the six switch TFTs 15 in the 7T1C sub-pixel driving circuit may also include at least one oxide TFT, and the driving TFT 14 is the LTPS-TFT. Because electrons in the LTPS-TFT have high mobility, a charging speed of a pixel capacitor may increase. Moreover, a leakage current of the oxide TFT is less than a leakage current of the LTPS-TFT. Therefore, the oxide TFT is used as the switch TFT, which is beneficial to reduce a leakage current of the sub-pixel driving circuit, thereby reducing power consumption of the sub-pixel driving circuit. Meanwhile, the LTPS-TFTs and the oxide TFT in the 7T1C sub-pixel driving circuit constitute a sub-pixel driving circuit having a low-temperature polycrystalline oxide (LTPO) structure. By combining the 7T1C sub-pixel driving circuit with the metal oxide TFT of the photocurrent sensors 13, the 8T1C sub-pixel driving circuit can be formed.

As shown in FIG. 2, the oxide TFT 15 and the photocurrent sensors 13 are disposed on a same first interlayer insulating layer 114, and the oxide TFT 15 and the photocurrent sensors 13 can be formed simultaneously. As a result, the photocurrent sensors 13 can be formed without additional manufacturing processes.

In the present embodiment, the driving TFT 14 is disposed on a side of the buffer layer 112 away from the substrate 111 and includes a first tunnel layer 141, a first gate line layer 142, and a first source/drain electrode layer 143. The first tunnel layer 141 is disposed on the buffer layer 112, the first gate line layer 142 is disposed on the first gate insulating layer 113 and is disposed on a side of the first tunnel layer 141 away from the substrate 111, and the first source/drain electrode layer 143 is disposed on the first interlayer insulating layer 114 and is in contact with the first tunnel layer 141 by a through hole penetrating through the first interlayer insulating layer 114 and the first gate insulating layer 113. In the present embodiment, the driving TFT 14 is a top-gate TFT. Of course, in other embodiment, the driving TFT 14 may also be a bottom-gate TFT or a double-gate TFT, which is not limited here.

As shown in FIG. 1, the display panel 100 further includes an encapsulation layer 15 disposed on the display device layer 12. The encapsulation layer 15 includes a first non-organic layer 151 covering the cathode 125, a first organic layer 152 covering the first non-organic layer 151, and a second non-organic layer 153 covering the first non-organic layer 151 and the first organic layer 152. A touch layer 16 is disposed on a side of the second non-organic layer 153 away from the display device layer 12. In other embodiments, the touch layer 16 may also be disposed between the encapsulation layer 15 and the display device layer 12, which is not limited here. An encapsulation plate 17 is further disposed on a side of the touch layer 16 away from the encapsulation layer 15.

Regarding the beneficial effects: an embodiment of the present disclosure provides a display panel, a plurality of photocurrent sensors are disposed on a plurality of light detecting areas between adjacent sub-pixel areas, different photocurrent sensors on different light defecting areas detect ambient brightnesses of different areas, photo signals are converted into electrical signals by a sub-pixel driving circuit, and a blocked area and a non-blocked area can be recognized by a first controller according to the electrical signals in different sub-pixel areas. As a result, the sub-pixel areas of the non-blocked area can be compensated, a brightness of the non-blocked area can increase, and contrast uniformity in the display panel and contrast uniformity between the blocked area of the mobile terminal and the non-blocked area of the mobile terminal can be realized.

An embodiment of the present disclosure further provides a mobile terminal, including the display panel provided by the above embodiments. All technical effects of the display panel provided by the above embodiments may also be realized by the mobile terminal and are not described again here. The mobile terminal may be wearable devices such as a smart bracelet, a smartwatch, or a virtual reality device, may be foldable and rollable organic light-emitting diode display devices, or may be display devices such as an electrical book, an electrical newspaper, a cellphone, a television, or a computer.

In summary, the present disclosure has been described with preferred embodiments thereof. The preferred embodiments are not intended to limit the present disclosure, and it is understood that many changes and modifications to the described embodiment can be carried out without departing from the scope and the spirit of the disclosure that is intended to be limited only by the appended claims.

What is claimed is:

1. A display panel, comprising:

an array substrate, wherein the array substrate comprises a plurality of sub-pixel areas arranged in an array, wherein a sub-pixel driving circuit is disposed in the sub-pixel areas, and wherein a plurality of light detecting areas are disposed between adjacent sub-pixel areas;

a plurality of photocurrent sensors, wherein the photocurrent sensors are disposed in the light detecting areas and are connected to the sub-pixel driving circuit;

a display device layer, wherein the display device layer is disposed on the array substrate and the photocurrent sensors; and a first controller, wherein the first controller is connected to the sub-pixel driving circuit;

wherein the array substrate comprises a substrate and a buffer layer disposed on the substrate, wherein the photocurrent sensors are disposed between the display device layer and the buffer layer, wherein the sub-pixel driving circuit comprises a plurality of thin film transistors (TFTs), wherein the TFTs comprise at least one oxide TFT, and wherein the at least one oxide TFT and the photocurrent sensors have a same structure and are disposed in a same layer.

2. The display panel of claim 1, wherein the photocurrent sensors comprise a gate line layer, a tunnel layer, and a source/drain electrode layer which are stacked, and a material of the tunnel layer comprises a metal oxide.

3. The display panel of claim 2, wherein the metal oxide comprises indium gallium zinc oxide, indium gallium oxide, indium tin zinc oxide, or aluminum zinc oxide.

4. The display panel of claim 1, wherein the TFTs comprise a driving TFT disposed on a side of the buffer layer away from the substrate, the driving TFT comprises a first tunnel layer, a first gate line layer, and a first source/drain electrode layer, and the first gate line layer is disposed on a side of the first tunnel layer away from the substrate.

5. The display panel of claim 1, wherein the sub-pixel driving circuit comprises seven thin film transistors (TFTs) and one storage capacitor.

6. The display panel of claim 1, wherein the first controller is a microcontroller or a central controller.

7. A mobile terminal, comprising the display panel of claim 1.

* * * * *